US009520676B1

(12) United States Patent
Chen

(10) Patent No.: US 9,520,676 B1
(45) Date of Patent: Dec. 13, 2016

(54) COMMUNICATION CONNECTOR

(71) Applicant: SURTEC INDUSTRIES INC., Keelung (TW)

(72) Inventor: Chou-Hsing Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 14/924,883

(22) Filed: Oct. 28, 2015

(51) Int. Cl.

| | |
|---|---|
| ***H01R 29/00*** | (2006.01) |
| ***H01R 13/646*** | (2011.01) |
| ***H01R 13/66*** | (2006.01) |
| ***H01R 13/70*** | (2006.01) |

(52) U.S. Cl.
CPC ..... *H01R 13/646* (2013.01); *H01R 13/665* (2013.01); *H01R 13/70* (2013.01)

(58) Field of Classification Search
CPC ... H01R 12/7094; H01R 13/641; H01R 13/70; H01R 13/703; H01R 13/7039; H01R 13/713; H01R 24/46
USPC ..... 439/188, 620.17, 676, 955
See application file for complete search history.

(56) References Cited

U.S. PATENT DOCUMENTS

| | | | | |
|---|---|---|---|---|
| 6,139,343 | A * | 10/2000 | Arnett | H01R 29/00 200/51.06 |
| 6,736,681 | B2 * | 5/2004 | Arnett | H05K 1/0228 439/676 |
| 7,988,499 | B2 * | 8/2011 | Lin | H01R 27/00 439/701 |
| 9,281,621 | B2 * | 3/2016 | Tian | H01R 13/6463 |
| 2014/0315436 | A1 * | 10/2014 | Poulsen | H01R 13/6658 439/620.23 |
| 2015/0056824 | A1 * | 2/2015 | Bolouri-Saransar | H01R 4/24 439/64 |

* cited by examiner

*Primary Examiner* — Phuong Dinh
(74) *Attorney, Agent, or Firm* — Skaar Ulbrich Macari, P.A.

(57) ABSTRACT

A communication connector is provided which can selectively provide compensation to the electrical circuits thereof. The communication connector includes a housing, a circuit board arrangement, contacts and a switchable device. The circuit board arrangement is disposed in the housing and includes electrical circuits and contact pads electrically connected to each other; the contacts is disposed at the circuit board arrangement and electrically connected to the electrical circuits respectively; the switchable device is movable in relative to the circuit board arrangement and has a compensation circuit board and switching contacts electrically connected to each other. The switchable device can be selectively moved to a predetermined position to enable the switching contacts to make contact with the contact pads respectively and enable the compensation circuit board to electrically connect to the electrical circuits.

15 Claims, 23 Drawing Sheets

COMMUNICATION CONNECTOR

FIELD

The present invention relates to a communication connector and more particularly to a RJ45 communication connector.

BACKGROUND

US 2015/0056824 A1 discloses a communication connector having two communication interfaces that are switchable. One of the interfaces is IEC 61076-3-110 GG45 and the other of the interfaces is TIA-1096-ARJ. This connector cannot provide the uniformity of a RJ45 interface.

US 2014/0315436 A1 discloses a communication connector comprising a plurality of contacts, a plurality of contact pads and an insulator comprising an insulating portion adjacent to the plurality of contact pads. The insulator is movable between an insulating position and a non-insulating position. The insulating portion of the insulator insulates the plurality of contact pads from the plurality of connector contacts when the insulator is in the insulating position. That provides the first one of the electrical performance modes. The plurality of connector contacts contact the plurality of contact pads when the insulator is in the non-insulating position. That provides the second one of the electrical performance modes.

With the communication connector of US 2014/0315436 A1, when the insulator is in the non-insulating position, with the contacts contacting the contact pads, the connector contacts have one free end, a cantilever beam or simple beam. The different flexibility of the contacts affect the connection the stability of the communication jack and communication plug. On the other hand, when the insulator is in the non-insulating position, the free end and the contact pads are not connected. However, an unstable capacitor is formed. With communications taking place in the high frequency range (over 1 GHz), there is a difficult problem as to how to resolve a time delay of the compensation. However, this problem is not addressed in US 2014/0315436 A1.

SUMMARY

Disclosed is a stable contact interface. The contact interface is in a stable state and has no flexibility issues that ensures the connection stability of communication jack and communication plug. The use of a switchable device provides a selective compensation function. The switchable device may be implemented in a communication plug or a communication plug. The present invention is compatible with the prior standards (ex. Category 6A performance) and the Category 8 performance standard of RJ45 communication connectors from the TIA TR 42.7 group.

Disclosed is a RJ45 communication connector, comprising: a housing; a circuit board arrangement, disposed in the housing and comprising a plurality of electrical circuits and a plurality of contact pads which are electrically connected to the electrical circuits respectively; a plurality of contacts, disposed at the circuit board arrangement and electrically connected to the electrical circuits respectively; a switchable device which is movable in relative to the circuit board arrangement, and the switchable device comprising a compensation circuit board and a plurality of switching contacts electrically connected to the compensation circuit board; wherein the switchable device is configured to selectively move to a predetermined position to enable the switching contacts to make contact with the contact pads respectively and enable the compensation circuit board to electrically connect to the electrical circuits.

The predetermined position of the switchable device can be a default position where the switchable device is not yet pushed, or can be the position where the switchable device has been pushed due to the insertion with a connector.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

In the following description, the present invention will be explained with reference to certain example embodiments thereof. However, these example embodiments are not intended to limit the present invention to any specific examples, embodiments, environment, applications or particular implementations described in these example embodiments. Therefore, description of these example embodiments is only for purpose of illustration rather than to limit the present invention.

Figure 1A:
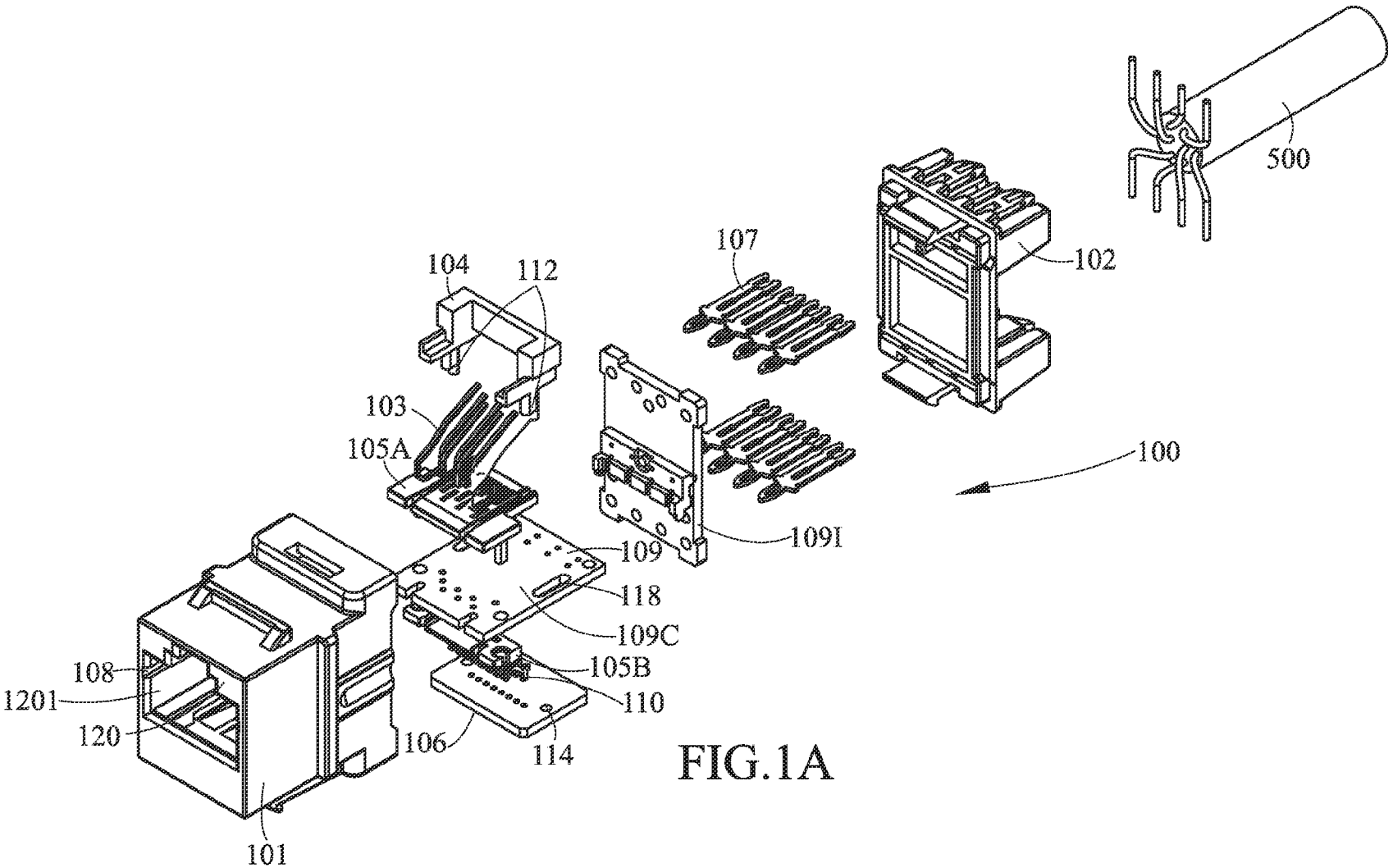
FIG. 1A is a bottom perspective exploded view of a communication jack according to an embodiment of the invention.
Figure 1B:
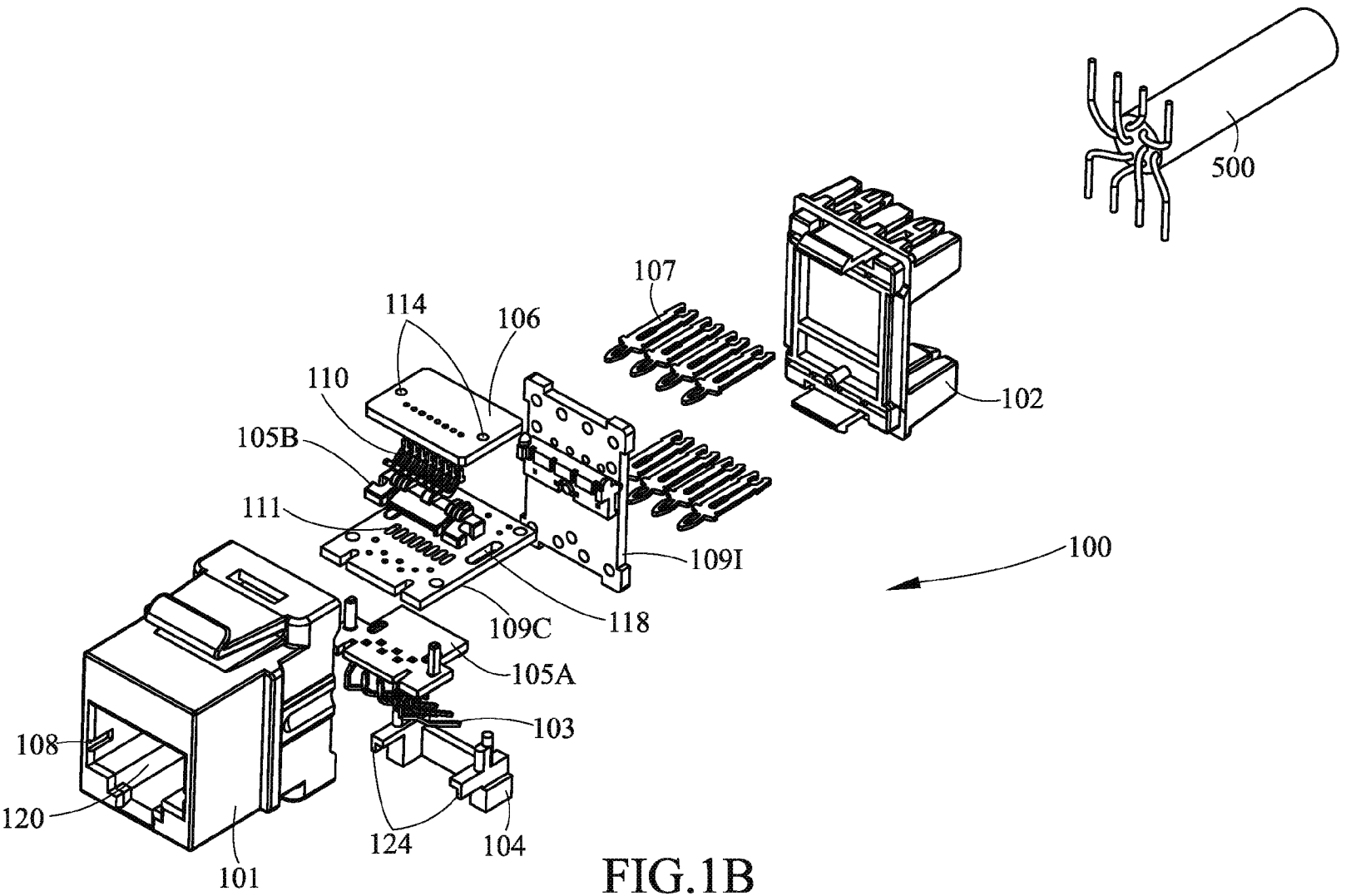
FIG. 1B is a top perspective exploded view of the communication jack of FIG. 1A.

Referring to the drawings, FIGS. 1A and 1B show a communication connector which is implemented as a communication jack 100 according to an embodiment of the invention. The communication jack 100 comprises a jack housing (or called the housing for short) 101 and a circuit board arrangement 109 which is disposed in and supported by the jack housing 101. The circuit board arrangement 109 may comprise one or more circuit boards 109C and 109I supported by the jack housing 101. The communication jack 100 also comprises a plurality of contacts 103 (i.e. the terminals) and a switchable device.

The circuit board arrangement 109 of the communication jack 100 comprises an insert 105A that carries the contacts 103, an insert 105B, a circuit board 109C (or called the main circuit board) and a circuit board 109I (or called the rear circuit board). The insert 105A is connected to the insert 105B and the circuit board 109C by posts of the insert 105A. Each of the circuit board 109C, the circuit board 109I, the insert 105A and the insert 105B are fixed relative to the jack housing 101. The circuit board 109C has a plurality of contact pads 111 that are electrically connected to the contacts 103 respectively.

Figure 3A:
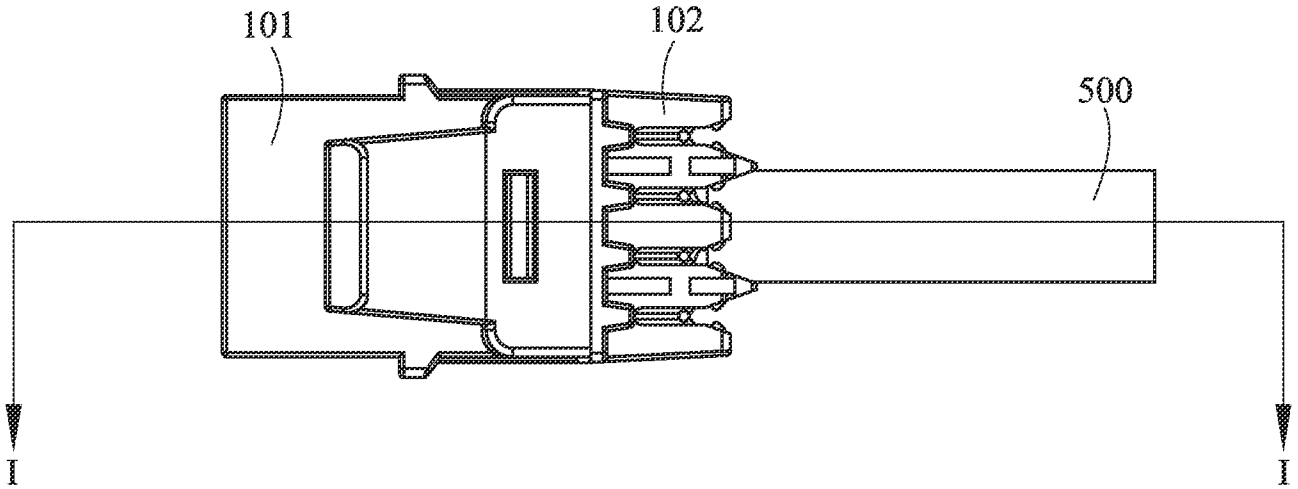
FIG. 3A is a top view of the communication jack of FIG. 1A, shown connected to a cable.
Figure 3B:
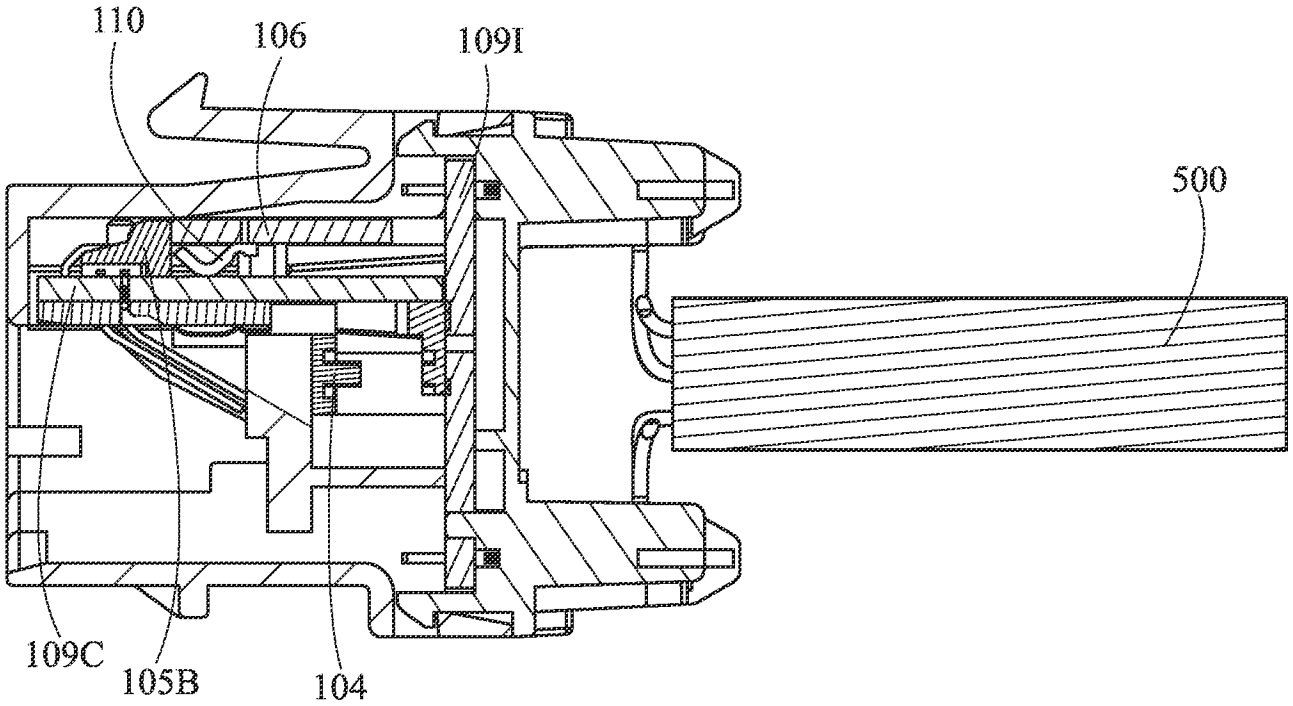
FIG. 3B is a cross-sectional view of the communication jack, taken along section line I-I of FIG. 3A.
Figure 3C:
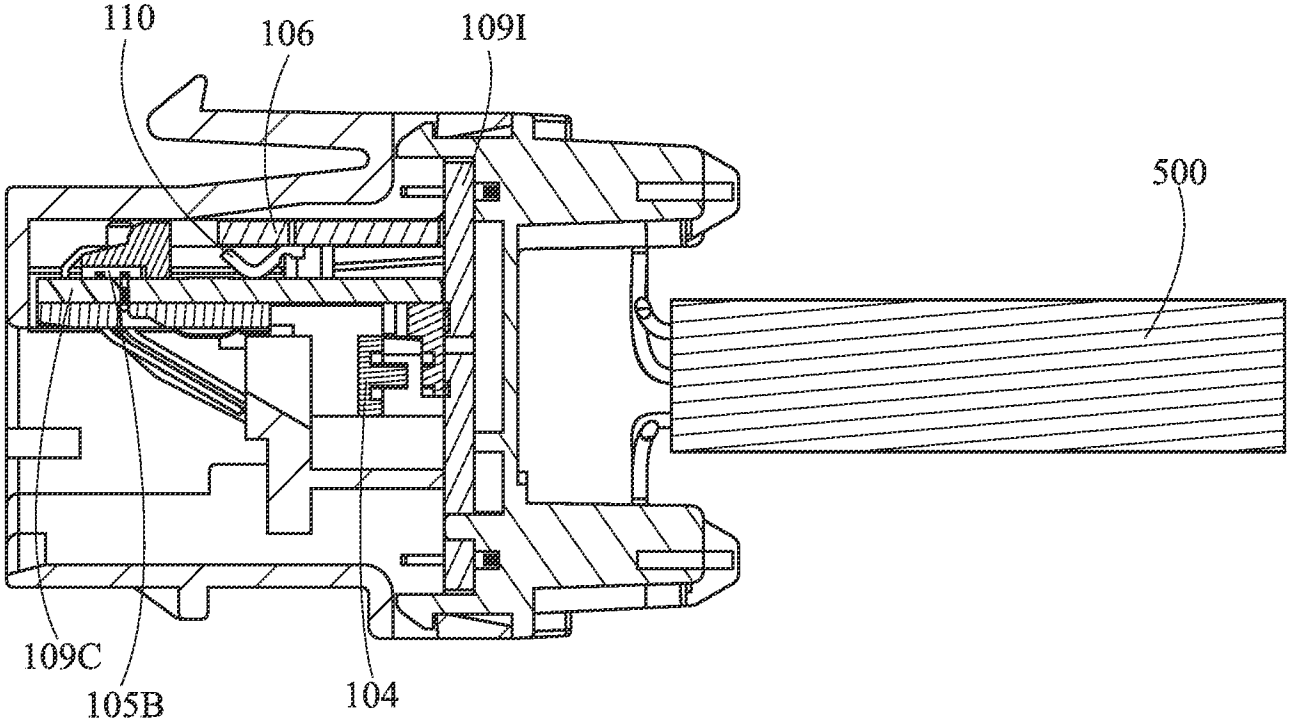
FIG. 3C is another cross-sectional view of the communication jack, taken along section line I-I of FIG. 3A.

The circuit board 109I is connected to a plurality of insulation displacement contacts (IDCs) 107. The circuit board 109I, with IDCs 107 mounted thereto, is connected to a seat 102. The seat 102 has slots corresponding the slots of the IDCs 107, to receive individual wires of a cable 500. The seat 102, connecting to the circuit board 109I with the IDCs 107, is snap connected to the jack housing 101 to form an housing assembly as shown in FIGS. 3A to 3C.

The circuit board 109I is further connected to and cooperates with the main circuit board 109C to provide electrical circuits, i.e. connections (signal paths), from individual IDCs 107 to respective contacts 103. The signal paths are preferably pairs of communication paths.

The switchable device comprises a compensation circuit board 106 and a plurality of switching contacts 110. The switchable device is also disposed within the housing 101 and is movable relative to the circuit board arrangement 109, as well as the housing 101, along a plug insertion direction; namely, the switchable device is movable within the housing 101. The compensation circuit board 106 includes one or more compensation circuits 11J and 12J (shown in FIG. 3D) which are disposed on or embedded in the compensation circuit board 106. The compensation circuits 11J and 12J include circuit components to provide impedances Z1J and Z2J that may be selectively connected to the contact pads 111 to change characteristics of the signal paths associated with contacts 103 and IDCs 107. Those circuit components to provide impedances Z1J and Z2J are selected according to the needed characteristics of compensation, and are well known to the people having ordinary skill in the art.

Preferably, the switchable device further comprises an actuating structure 104 which is fixed to the compensation circuit board 106 within the housing 101, and thus movable together with the compensation circuit board 106 in the plug insertion direction over a range. The actuating structure 104 has one or plural posts 112 (ex. two post) that pass through one or plural slots 118 of the circuit board 109C and are fixed in the receiving openings 114 of the compensation circuit board 106. Alternatively, the posts 112 can be formed on the compensation circuit board 106 to pass through the slots 118 and fixed in the corresponding openings of the actuating structure 104 (not shown).

The circuit board 109C is located between the actuating structure 104 and the compensation circuit board 106, and thus the switching contacts 110 are located between the compensation circuit board 106 and the circuit board 109C. The compensation circuit board 106 carries and electrically connect to the switching contacts 110, and the switching contacts 110 is moved axially upon moving the actuating structure 104.

Figure 3D:
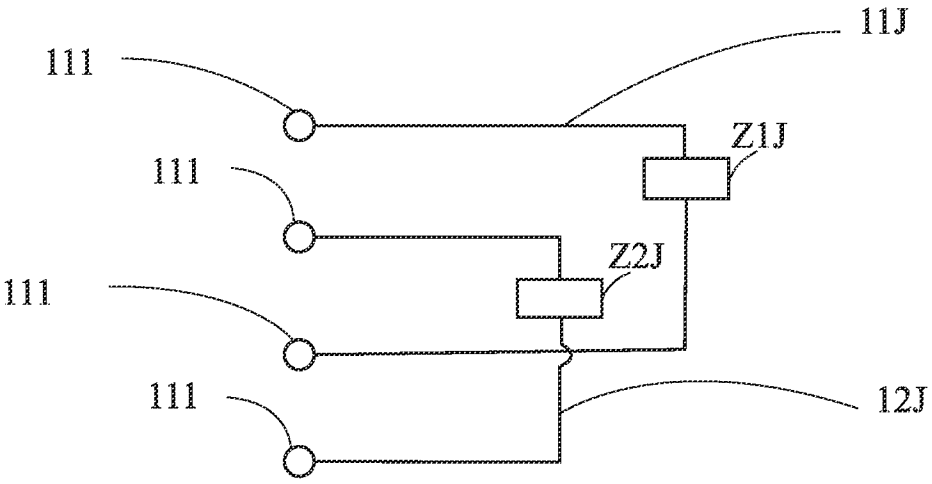
FIG. 3D is a schematic view of compensation circuits of the communication jack of FIG. 1A.

The switching contacts 110, on the compensation circuit board 106, are selectively making contact with the contact pads 111 in a first (predetermined) position of the switchable device. As such, the compensation circuits 11J and 12J as shown in FIG. 3D on the compensation circuit board 106 are electrically connected to the respective signal paths associated with contacts 103. The compensation circuit board 106 can moved with the actuating structure 104 such that the switching contacts 110 do not make contact with the contacts pads 111 in a second position (non-contact position) of the switchable device.

The actuator structure 104 acts as an actuator to change the switch state of the switching contacts 110 cooperating with the contact pads 111. The actuator structure 104 can comprise a fitting 124 (which preferably is a protrusion to match a fitting 209 shown in FIG. 4A) on the front edge of the actuator structure 104.

The housing 101 has a plug socket 120 that is sized to receive a RJ plug, and the contacts 103 are located within the plug socket 120 to be accessible to the RJ plug; the actuator structure 104 is also located within the plug socket 120 to be accessible to the RJ plug. The housing 101 has an lateral surface 1201 in the region of the plug socket 120 that is formed with a recess 108 (also shown in FIG. 2), at each side of the plug socket 120. The recess 108 provides clearance for an actuator tab 208 of the communication plug 200 according to another embodiment of the invention (shown in FIG. 4A) which will be detailed later.

Now also referring to FIGS. 3A-3D which mainly illustrate the operation of the switchable device of the communication jack 100. As shown in FIG. 3B, the compensation circuit board 106 and the main circuit board 109C are in the electrical connection state (i.e. in the predetermined position). In this state, the compensation circuit board 106 provides at least one pair to pair compensation coupling to the electrical circuits of the circuit board arrangement 109, so that the default (original) coupling of electrical circuits will be changed to different values (i.e. to increase or reduce the default coupling); namely, the electrical circuits has a default coupling, and the compensation circuit board 106 provides a compensation coupling to switch the default coupling to different values.

As shown in FIG. 3C, the compensation circuit board 106 and the main circuit board 109C are not in electrical connection, so no compensation is provided to the electrical circuits of the circuit board arrangement 109; namely, the electrical characteristic (ex. coupling) of the electrical circuits of the circuit board arrangement 109 is not adjusted by the compensation circuit board 106. In this non-electrical connection state, the compensation circuit board 106 is electrically isolated from the circuit board arrangement 109, so the electronic components providing the compensation circuit of the compensation circuit board 106 are less likely to influence the electrical circuits of the circuit board arrangement 109.

It is noted that the communication jack 100 can have one of electrical connection state (FIG. 3B) and non-electrical connection state (FIG. 3C) as its default state (i.e. where the communication jack 100 is not yet inserted by the RJ plug. That is to say, by modifying the positions of the contact pads 111 on the circuit board 109, the switching contacts 110 and the contact pads 111 make contact with each other when the compensation circuit board 106 is moved backward, or do not make contact with each other when the compensation circuit board 106 is moved backward.

Figure 4A:
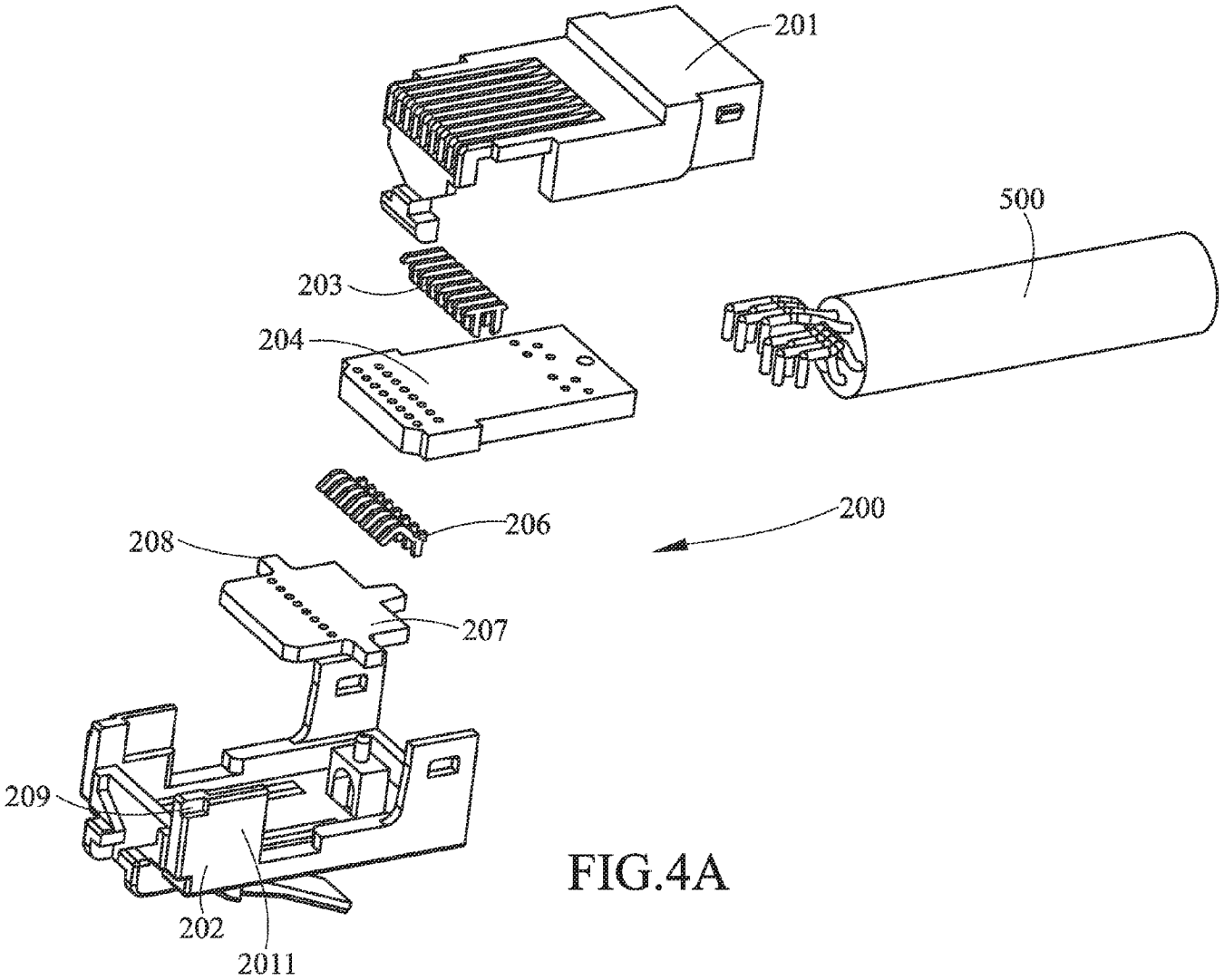
FIG. 4A is a top perspective exploded view of a communication plug according to another embodiment of the invention.
Figure 4B:
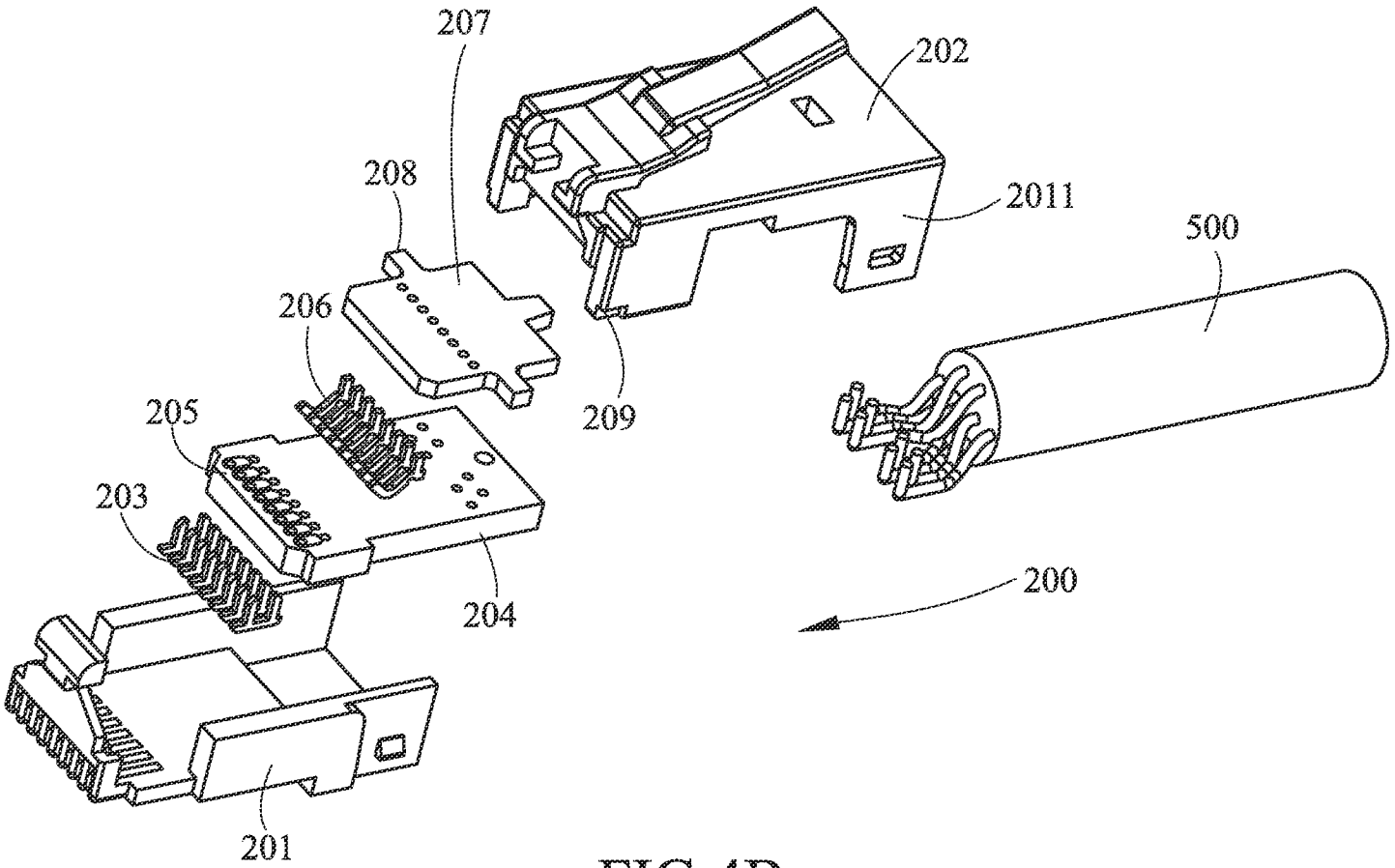
FIG. 4B is a bottom perspective exploded view of the communication plug of FIG. 4A.

Please now refer to FIGS. 4A and 4B, a communication connector that is implemented as a communication plug 200 according to another embodiment of the invention is disclosed, which also comprises a switchable device to selectively provide the compensation as the communication jack 100 does. The communication plug 200 comprises a plug housing 201, which cooperates with a plug seat 202 to form a housing assembly, a plurality of contacts 203, a circuit board arrangement 204 and a switchable device. The housing 201 and the seat 202 support the circuit board arrangement 204 which can be formed by one circuit board 204 (i.e. the main circuit board), and the contacts 203 are supported by and electrically connected to the circuit board 204. The circuit board 204 is also connected to the wires of a cable 500 and provides signal paths from the wires of the cable 500 to the respective contacts 203.

The circuit board 204 has a plurality of contact pads 205 (shown in FIG. 4B) that are each electrically connected to a respective one of the signal paths associated with contacts 203. The housing 201 and the seat 202 support the switchable device which comprises a compensation circuit board 207 and a plurality of switching contacts 206. The switching contacts 206 are fixed and electrically connected to the compensation circuit board 207, the compensation circuit board 207 is spaced apart from the circuit board 204, and thus the switching contacts 206 are located between the compensation circuit board 207 and the circuit board 204

Figure 6A:
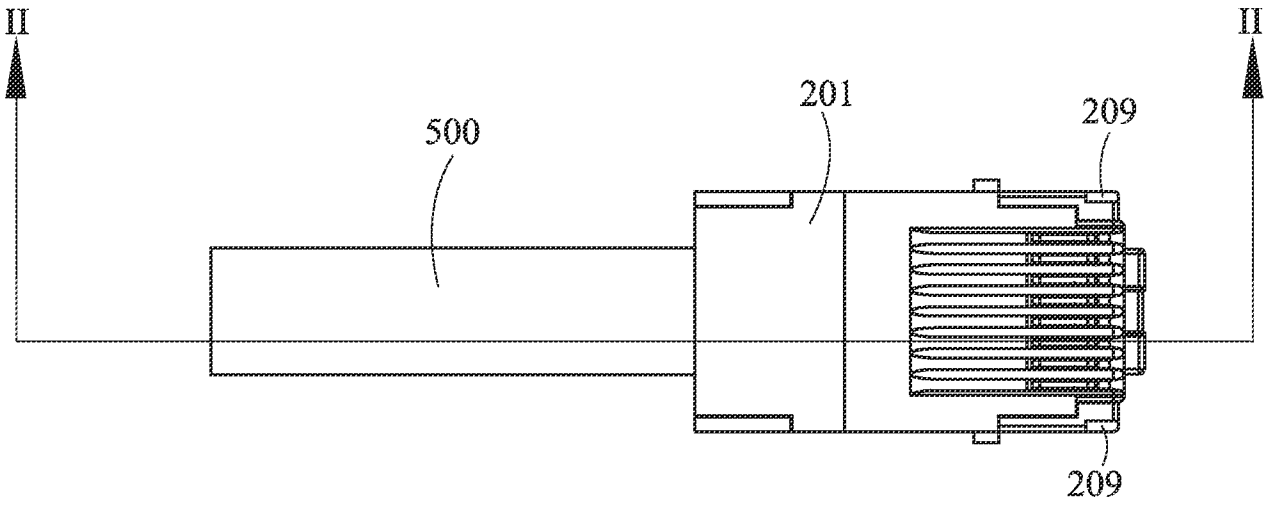
FIG. 6A is a top view of the communication plug of FIG. 4A, shown connected to a cable.
Figure 6B:
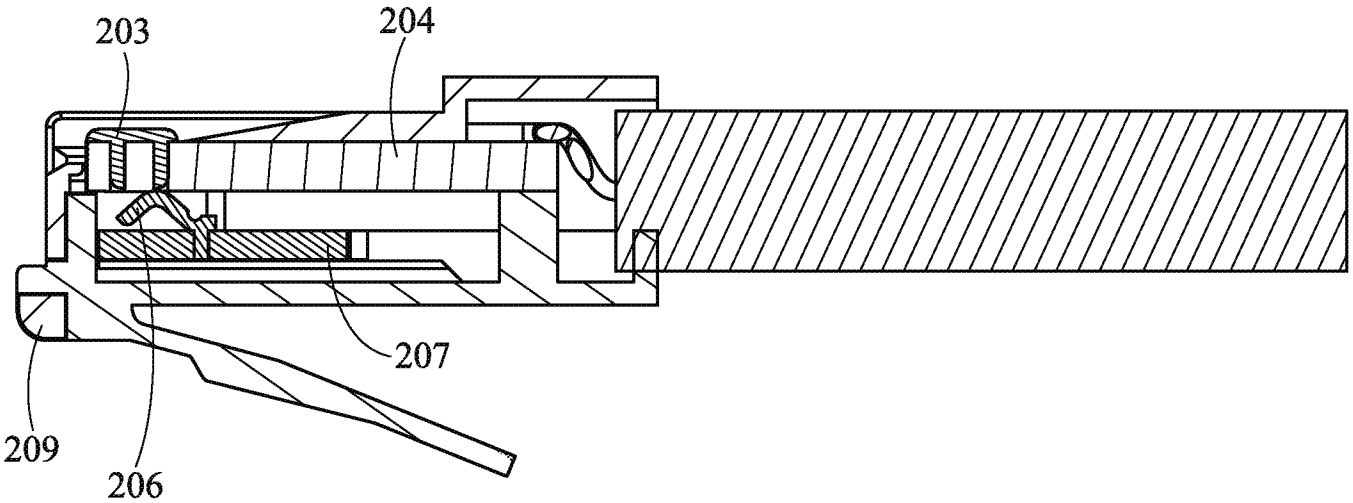
FIG. 6B is a cross-sectional view of the communication plug, taken along section line II-II of FIG. 6A.
Figure 6C:
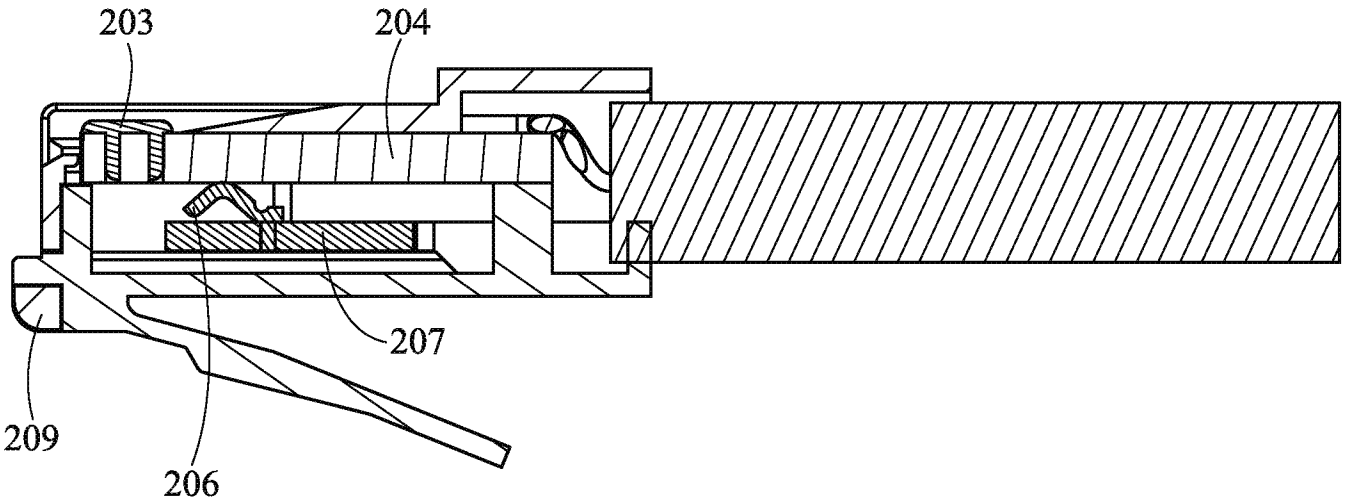
FIG. 6C is another cross-sectional view of the communication plug, taken along section line II-II of FIG. 6A.
Figure 6D:
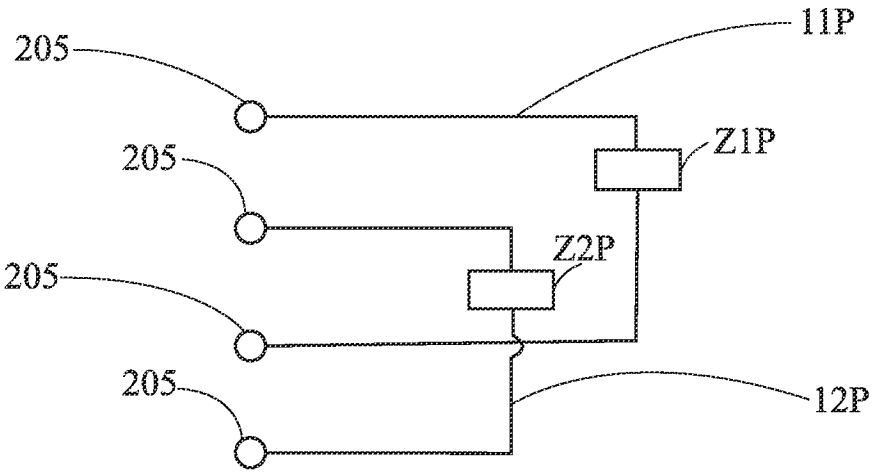
FIG. 6D is a schematic view of compensation circuits of the communication plug of FIG. 4A.

The switching contacts 206 are movable in an axial direction (i.e. the insertion direction) with the compensation circuit board 207 relative to the housing 201 and the seat 202. This allows the switching contacts 206 to selectively make contact to the contact pads 205 to electrically connect to the signal paths associated with contacts 203. The compensation circuit board 207 includes one or more compensation circuits 11P and 12P (shown in FIG. 6D) that include circuit components to provide impedances Z1P and Z2P and are selectively connected to contacts pads 205 to change characteristics of the signal paths associated with contacts 203; preferably, the compensation circuit board 207 provides at least one pair to pair compensation coupling to the electrical circuits of the circuit board arrangement 204.

Figure 5:
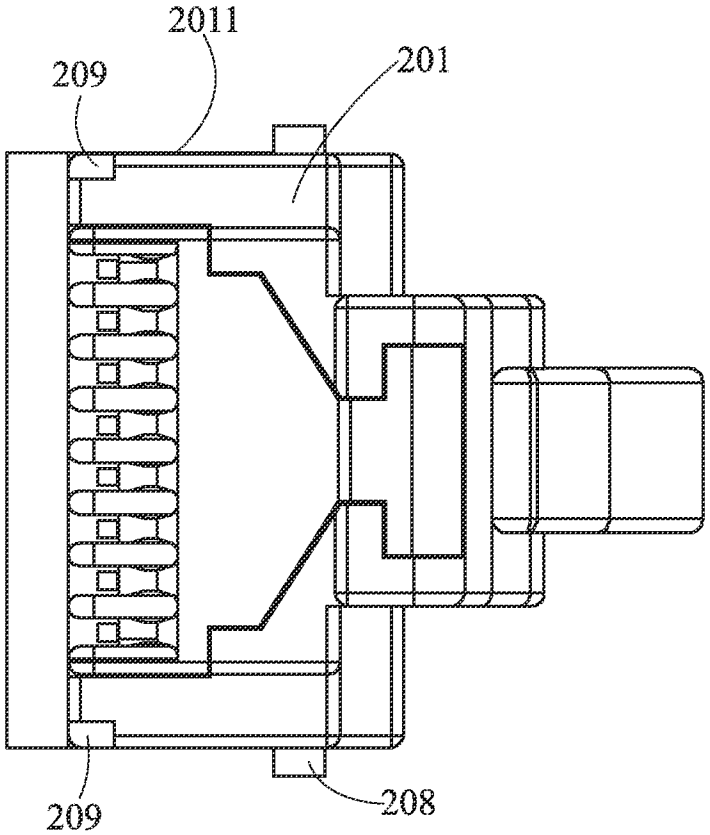
FIG. 5 is a front view of the communication plug of FIG. 4A.

The compensation circuit board 207 preferably includes one or plural actuating tabs 208 (ex. two tabs). The actuating tabs 208 are fixed to the both sides of the compensation circuit board 207 and move in an axial direction (in an insertion direction) with the compensation circuit board 207 relative to the housing 201 and the seat 202. The actuating tabs 208 protrude from the lateral surfaces 2011 of the seat 202 to be accessible outside the housing 201 as shown in FIG. 5.

Figure 2:
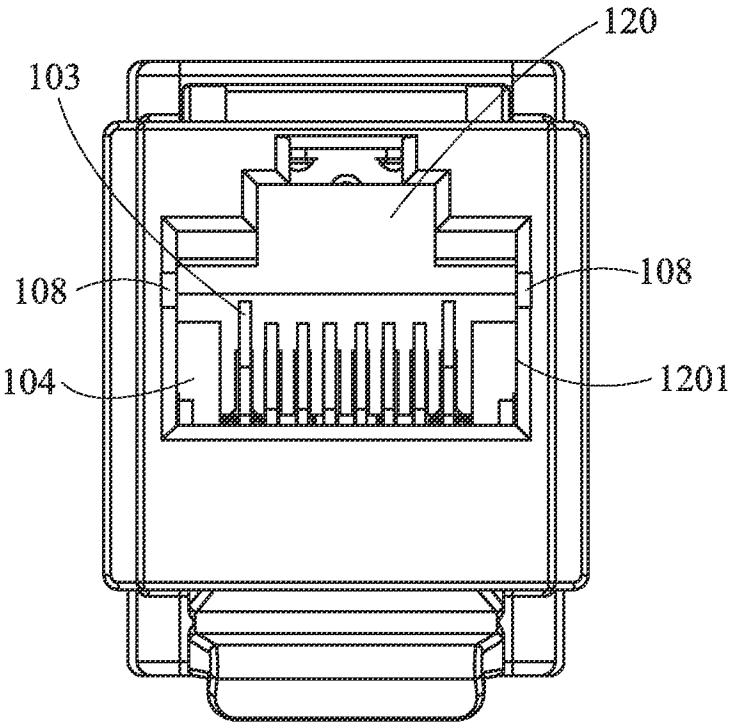
FIG. 2 is a front view of the communication jack of FIG. 1A.
Figure 7A:
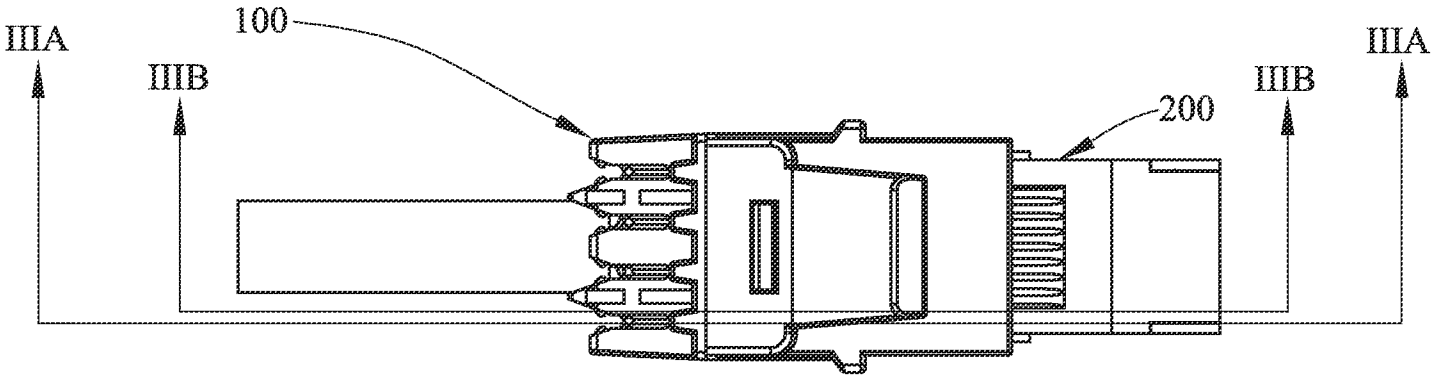
FIG. 7A is a top view showing the communication plug of FIG. 4A plugged into the communications jack of FIG. 1A.

The actuating tabs 208 cooperate with the recesses 108 of the communication jack 100 (shown in FIG. 2). The recesses 108 each form a clearance space to accommodate the actuating tabs 208 when the communication plug 200 is inserted into the plug socket 120 of the communication jack 100 (as shown in FIG. 7A, and will detailed later), so that the compensation circuit board 207 is not pushed backward. As such, the compensation circuit board 207 is in a state with the switching contacts 206 are connected to the contact pads 205. As such, the compensation circuits 11P and 12P affect the characteristics of the signal paths associated with contacts 203.

Figure 9A:
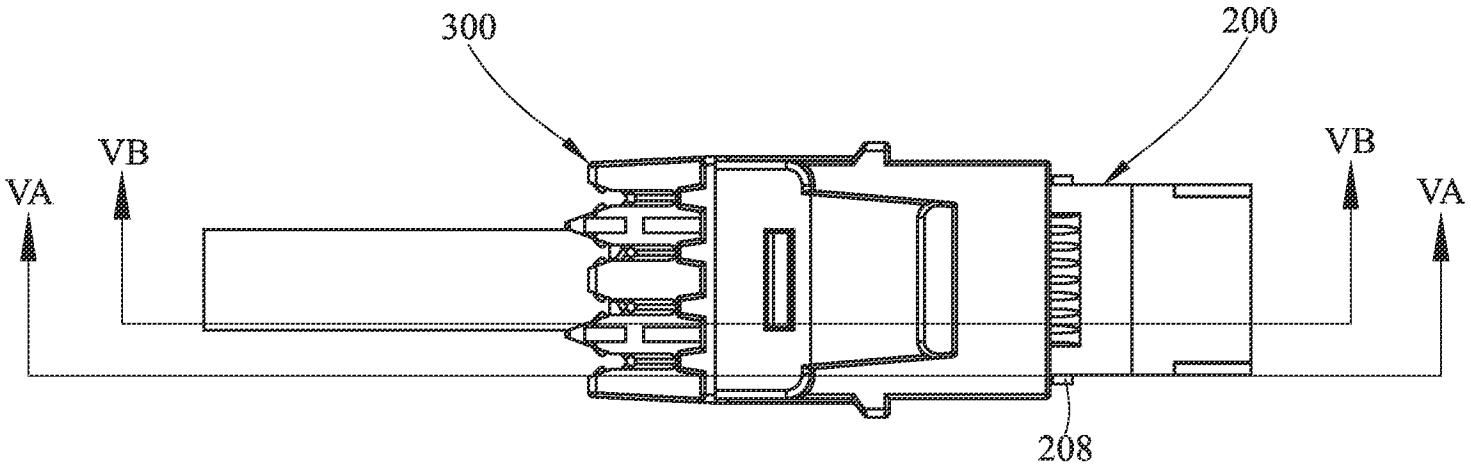
FIG. 9A is a top view showing the communication plug of FIG. 4A plugged into a communications jack.

While the plug 200 is inserted into a jack without the corresponding recesses within the socket (as shown in FIG. 9A, and will detailed later), the actuator the tabs 208 engage the side walls of such jack to be pushed backward, thereby making the compensation circuit board 207 and the switching contacts 206 move backwards. As such, the compensation circuit board 207 is in a state where the switching contacts 206 not connected to the pads 205. Then, the compensation circuits 11P and 12P do not affect the characteristics (ex. coupling) of the signal paths associated with contacts 203.

It is noted that, by modifying the positions of the contact pads 205 on the circuit board 204, the switching contacts 206 and the contact pads 205 make contact with each other when the compensation circuit board 207 is moved backward, and do not make contact with each other when the compensation circuit board 207 is not yet moved.

The seat 202 of the communication plug 200 includes a fitting 209 in the form of a recess (an indentation defined by one or both of the seat 202 and the housing 201) at each side of the lower front edge of the communication plug 200; the fitting 209 can also be formed on the lateral surface 2011 of the housing 201.

The fittings 209 allow the communication plug 200 to be inserted the plug socket 120 of the communication jack 100 without moving the actuating structure 104 of the communication jack 100 (as shown in FIG. 1A). Specifically, the fitting 209 forms a clearance space to accommodate the fitting 124 of the actuating structure 104 when the plug 200 is inserted into the plug socket 120, and thus the actuating structure 104 is not pushed by the housing 201. As such, the compensation circuits 11J and 12J (as shown in FIG. 3D) affect the characteristics of the signal paths associated with contacts 103.

The technical contents of the communication jack 100 and plug 200, which selectively provides the compensation (i.e. compensation coupling) to the electrical circuit by the switchable device, have been described above. Hereinafter, the operations of the communication jack 100 and plug 200 will be described.

Figure 7B:
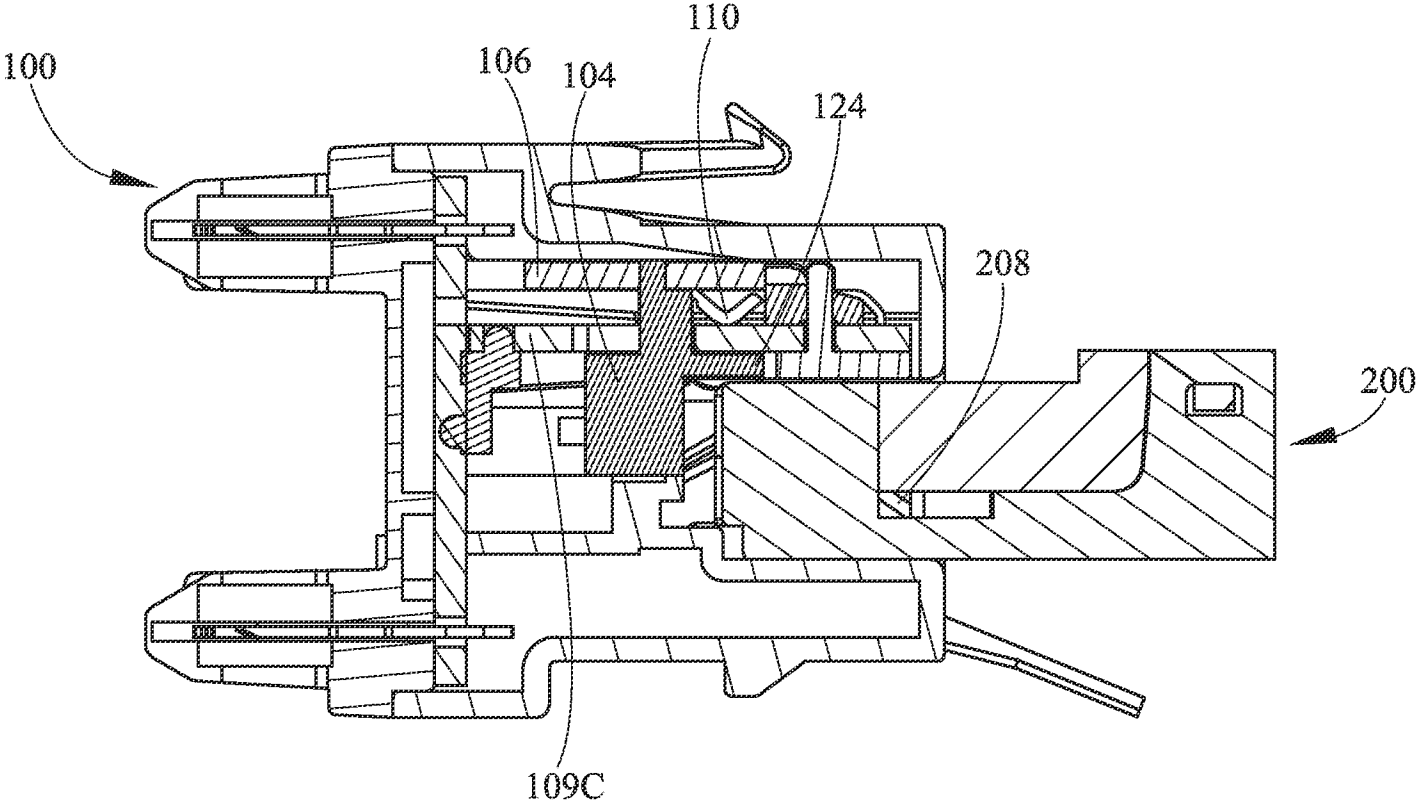
FIG. 7B is a cross-sectional view along section line IIIA-IIIA of FIG. 7A.
Figure 7C:
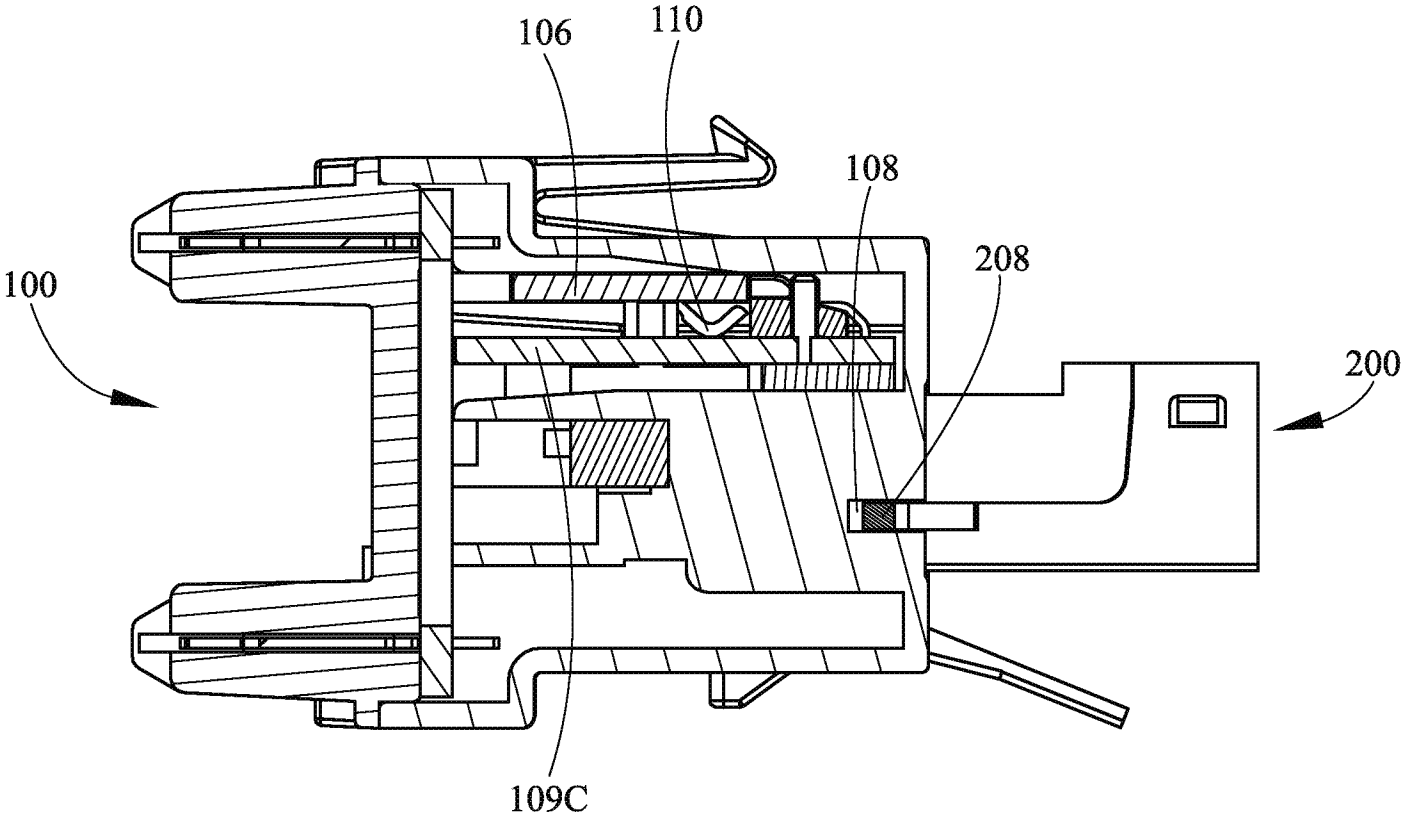
FIG. 7C is a cross-sectional view along section line IIIB-IIIB of FIG. 7A.

Referring to FIGS. 7A-7C as well as FIGS. 1A and 1B, the communication jack 100 and the communication plug 200 according to the embodiments of the invention can be configured as the connectors compatible with the Category 8 standard from TIA TR 42.7 group, and when the communication jack 100 and the communication plug 200 are mated with each other, the compensation circuit boards 106 and 207 of the respective communication jack 100 and communication plug 200 can remain still. That is, during the insertion, the actuating tabs 208 of the compensation circuit board 207 are accommodated within the recesses 108 of the communication jack 100, so the actuating tabs 208, as well as the compensation circuit board 207, are not pushed by the housing 101 of the communication jack 100; the fitting (i.e. protrusion) 124 of the actuating structure 104 is accommodated within the fitting (i.e.) 209 of the communication plug 200, so the actuating structure 104, as well as the compensation circuit board 106, is not pushed by the housing 201 of the communication plug 200.

When the compensation circuit boards 106 and 207 are not moved, the switching contacts 110 and 206 are in electrical connection with the respective contact pads 111 and 205 on circuit boards 109 and 204. In this electrical connection state, the compensation circuit boards 106 and 207 both provide the compensation to the electrical circuits, and therefore the electrical connection between the communication jack 100 and the communication plug 200 achieves the performance of Category 8 standard.

Alternatively, the communication jack 100 and the communication plug 200 can be configured that their electrical connection achieves the performance of Category 8 standard when no compensation is provided. In this configuration, the switching contacts 110 and 206 are not in electrical connection with the circuit boards 109 and 204 when the compensation circuit boards 106 and 207 remain still; thus, no compensation coupling is provided to change the default coupling of the electrical circuits.

Figure 8A:
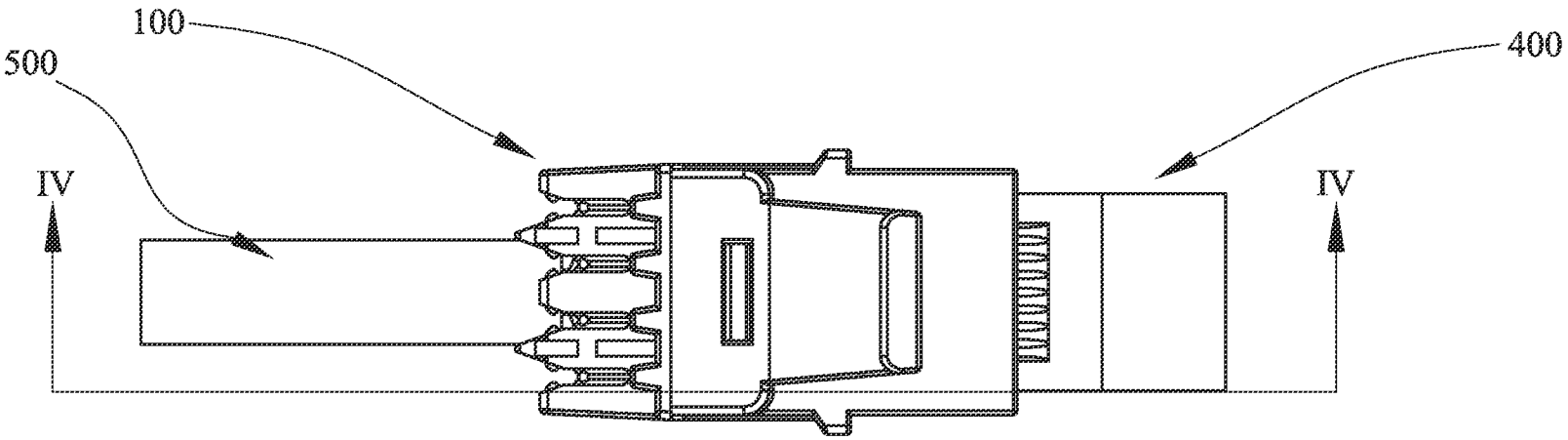
FIG. 8A is a top view showing a communication plug plugged into the communications jack according of FIG. 1A.
Figure 8B:
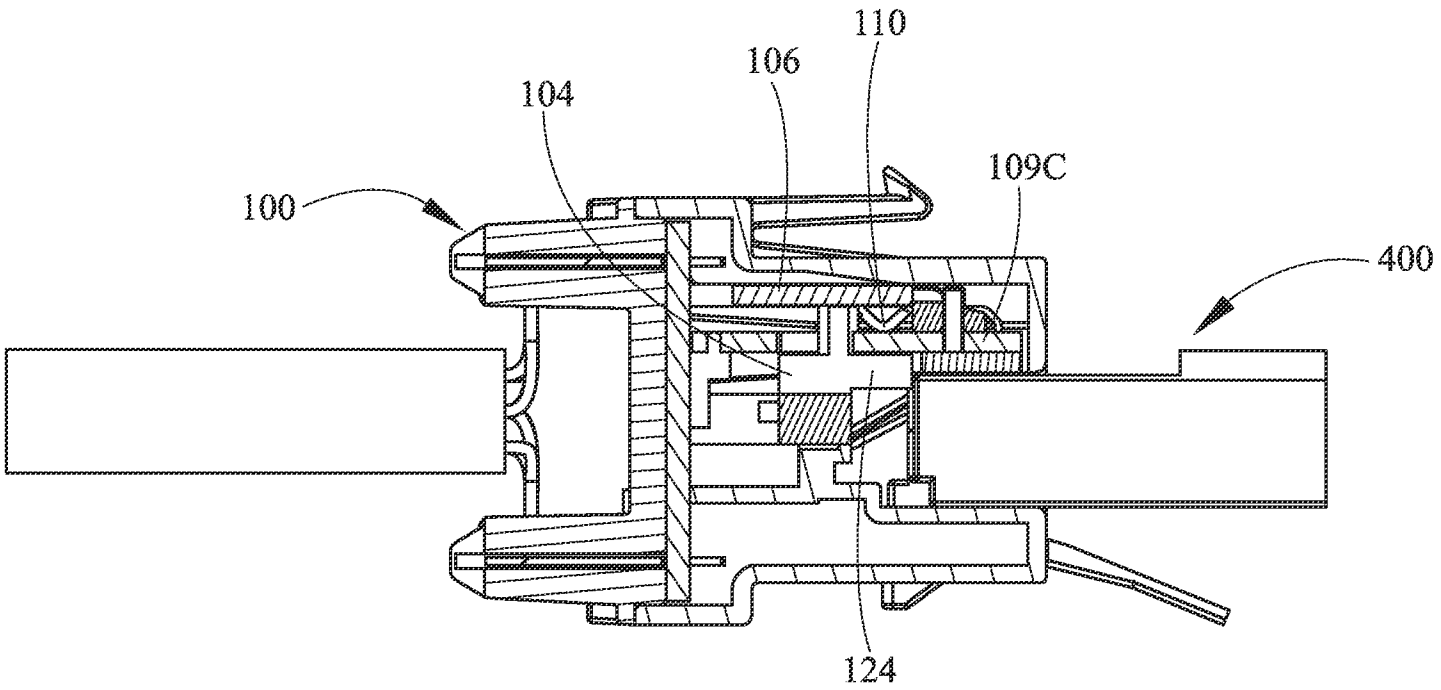
FIG. 8B is a cross-sectional view along section line IV-IV of FIG. 8A, showing a state prior to full insertion of the communication plug into the communications jack.
Figure 8C:
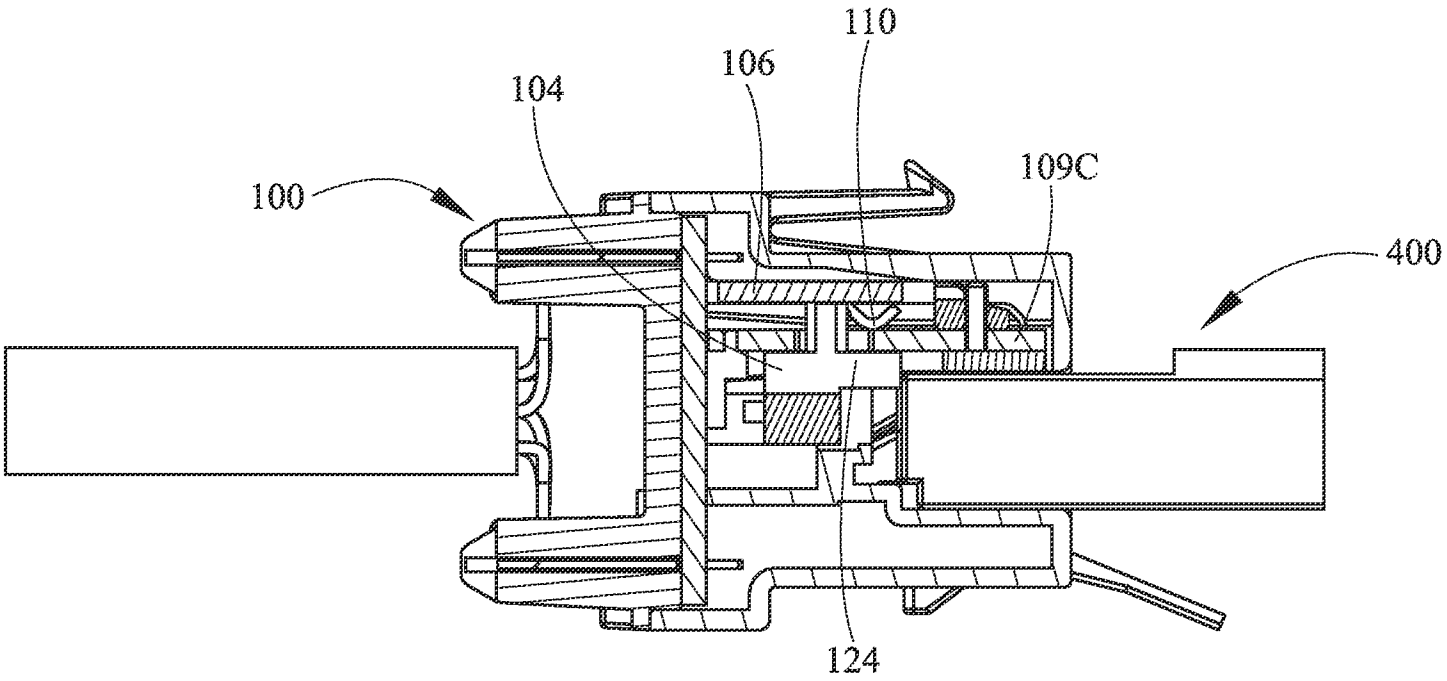
FIG. 8C is a cross-sectional view along section line IV-IV of FIG. 8A, showing a state of full insertion of the communication plug into the communications jack.

Referring to FIGS. 8A-8C as well as FIGS. 1A and 1B, the communication jack 100 can be mated with a plug 400 which is compatible with the Category 6A performance, and then the compensation circuit board 106 of the communication jack 100 will be pushed by the plug 400. That is, the front of the plug 400 without a corresponding recess pushes the fitting 124 of the actuating structure 104, and thus the compensation circuit board 106 fixed with the actuating structure 104 moves backwards.

As such, the switching contacts 110 on the compensation circuit board 106 move to a position where they are not in electrical connection with the contact pads 111 on the circuit board 109. In this state, no compensation is provided to the electrical connection between the communication jack 100 of Category 8 standard and the plug 400 of Category 6A standard, and the electrical connection achieves the performance of Category 6A standard. In other words, the communication jack 100 is backward compatible to the Category 6A standard without compensation provided.

Alternatively, the communication jack 100 and the plug 400 can be configured that their electrical connection achieves the performance of Category 6A standard when compensation is provided. In this configuration, the switching contacts 110 are in electrical connection with the circuit board 109 after the compensation circuit board 106 is moved by the insertion of the plug 400.

Figure 9B:
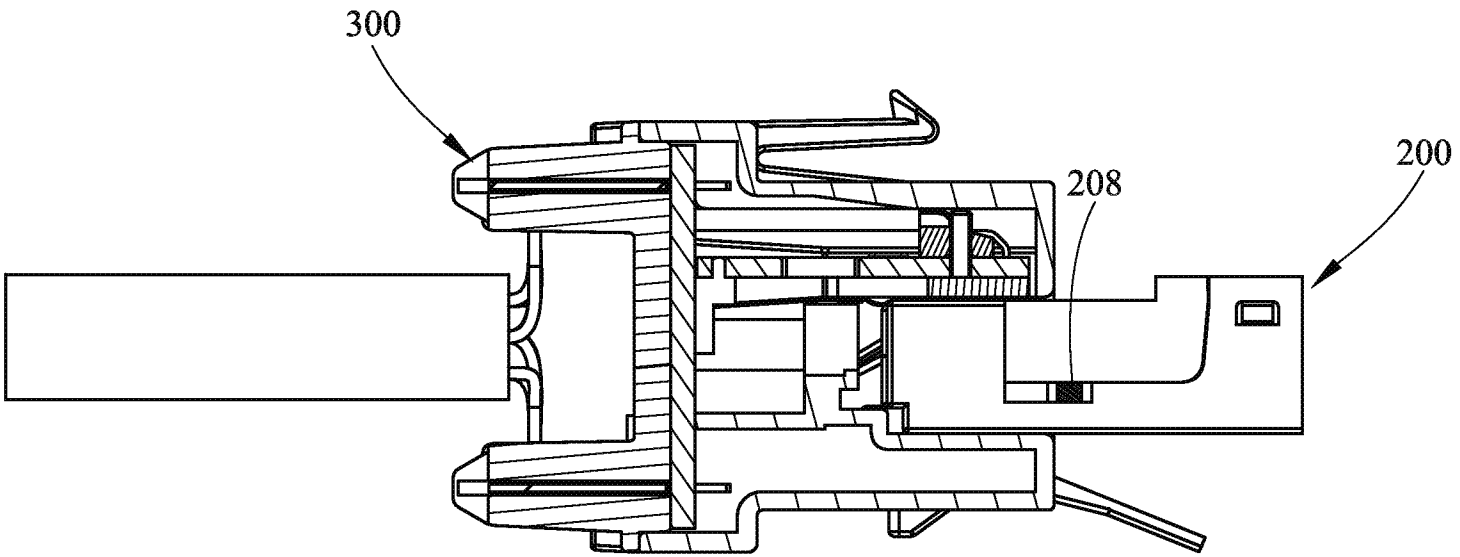
FIG. 9B is a cross-sectional view along section line VA-VA of FIG. 9A, showing a state prior to full insertion of the communication plug into the communications jack.
Figure 9C:
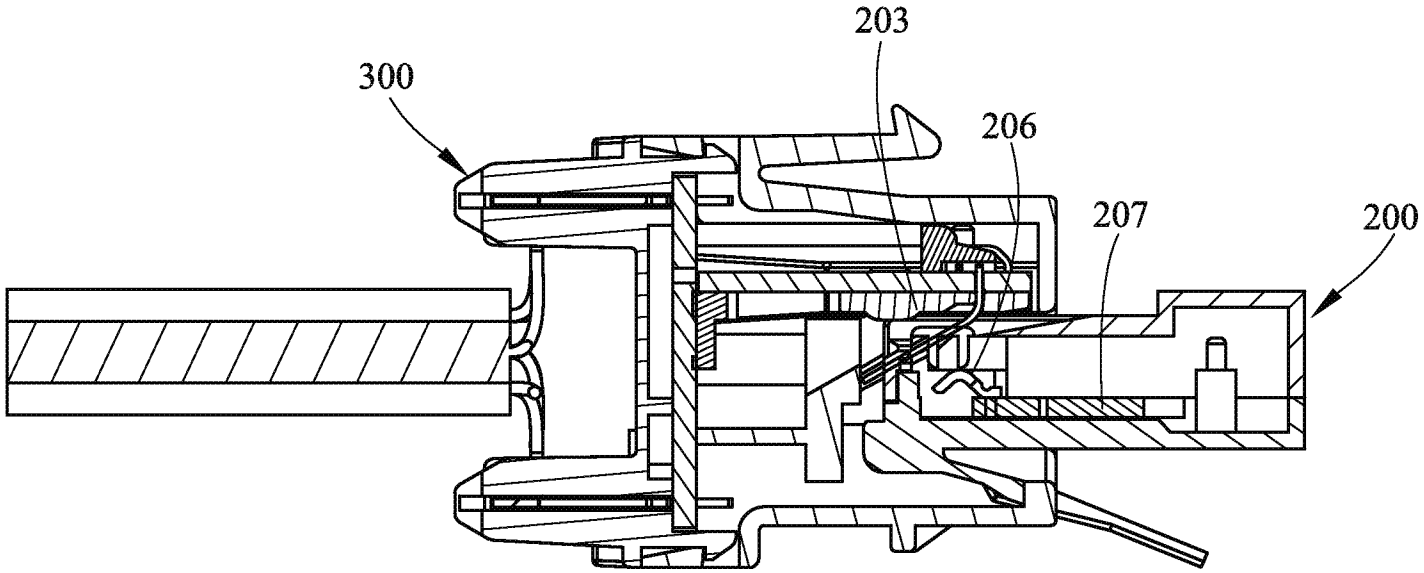
FIG. 9C is a cross-sectional view along section line VB-VB of FIG. 9A, showing a state of full insertion of the communication plug into the communications jack.

Referring to FIGS. 9A-9C as well as FIGS. 4A and 4B, the communication plug 200 can be mated with a jack 300 compatible with the Category 6A performance, and then the compensation circuit board 207 of the communication plug 200 will be pushed backward by the jack 300. That is, during the insertion, the plug socket of the jack 300 without a corresponding fitting touches and pushes the actuating tabs 208 of the compensation circuit board 207; the actuating tabs 208 may be left outside the plug socket of the jack 300.

As such, the switching contacts 206 on the compensation circuit board 207 move to a position in which they are not in electrical connection with the contact pads 205 on the circuit board 204. In this state, no compensation is provided to the electrical connection between the communication plug 200 of Category 8 standard and the jack 300 of Category 6A standard, and the electrical connection achieves the performance of Category 6A standard. In other words, the communication plug 200 is backward compatible to Category 6A standard without compensation provided.

Alternatively, the communication plug 200 and the jack 300 can be configured that their electrical connection achieves the performance of Category 6A standard when compensation is provided. In this configuration, the switching contacts 206 are in electrical connection with the circuit board 204 after the compensation circuit board 207 is moved.

Given the above, it is understood that by the compensation circuit boards 106 and 207 selectively providing the compensation to the electrical connection (i.e. to switch the coupling of the electrical connection to different values), the communication jack 100 and the communication plug 200 in the same standard (ex. Category 8) can compatibly mate with each other, and can be backward compatible to the connectors in different standard (ex. Category 6A), While specific embodiments of the invention have been shown and described in detail to illustrate the application of the principles of the invention, it will be understood that the invention may be embodied otherwise without departing from such principles.

What is claimed is:

1. A RJ45 communication connector, comprising:

a housing;

a circuit board arrangement, disposed in the housing and comprising a plurality of electrical circuits and a plurality of contact pads which are electrically connected to the electrical circuits respectively;

a plurality of contacts, disposed at the circuit board arrangement and electrically connected to the electrical circuits respectively; and a switchable device which is movable in relative to the circuit board arrangement, and the switchable device comprising a compensation circuit board and a plurality of switching contacts electrically connected to the compensation circuit board;

wherein the switchable device is configured to selectively move to a predetermined position to enable the switching contacts to make contact with the contact pads respectively and enable the compensation circuit board to electrically connect to the electrical circuits.

2. The RJ45 communication connector according to claim 1, wherein the compensation circuit board is configured to provide a compensation coupling to the electrical circuits when the switchable device moves to the predetermined position, so as to change an coupling of the electrical circuits.

3. The RJ45 communication connector according to claim 2 is implemented as a communication plug.

4. The RJ45 communication connector according to claim 3, wherein the compensation circuit board comprises an actuating tab which protrudes from a lateral surface of the housing.

5. The RJ45 communication connector according to claim 3, wherein the circuit board arrangement comprises a main circuit board where the contact pads and the contacts are disposed, and the main circuit board is spaced apart from the compensation circuit board, and the switching contacts are located between the main circuit board and the compensation circuit board.

6. The RJ45 communication connector according to claim 3, wherein the housing comprises a fitting on a lateral surface of the housing.

7. The RJ45 communication connector according to claim 6, wherein the fitting is a recess.

8. The RJ45 communication connector according to claim 2 is implemented as a communication jack.

9. The RJ45 communication connector according to claim 8, wherein the housing includes a plug socket and the contacts are located within the plug socket, and the switchable device further comprises an actuating structure which is fixed to the compensation circuit board and located within the plug socket.

10. The RJ45 communication connector according to claim 9, wherein the actuating structure comprises a fitting on a front edge of the actuating structure.

11. The RJ45 communication connector according to claim 10, wherein the fitting is a protrusion.

12. The RJ45 communication connector according to claim 9, wherein the plug socket comprises a recess formed on a lateral surface of the plug socket.

13. The RJ45 communication connector according to claim 9, wherein the circuit board arrangement comprises a main circuit board where the contact pads and the contacts are disposed, and the main circuit board is located between the actuating structure and the compensation circuit board; the switching contacts are located between the compensation circuit board and the main circuit board.

14. The RJ45 communication connector according to claim 13, wherein the main circuit board comprises a slot, and the switchable device further comprises a post which passes through the slot and fixes the actuating structure and the compensation circuit board.

15. The RJ45 communication connector according to claim 8, further comprising a plurality of insulation displacement contacts which are electrically connected to the electrical circuits respectively.

* * * * *